US006743151B2

(12) United States Patent
Riggs et al.

(10) Patent No.: US 6,743,151 B2
(45) Date of Patent: Jun. 1, 2004

(54) AUTO-CALIBRATING FORCE AND DIRECTION SENSING SCORING SYSTEM FOR FENCING

(76) Inventors: Edward J. Riggs, 804 Ashebrook Dr., Greensboro, NC (US) 27409; Paul M. Pappas, 2623A Yanceyville St., Greensboro, NC (US) 27405-4430

( * ) Notice: Subject to any disclaimer, the term of this patent is extended or adjusted under 35 U.S.C. 154(b) by 4 days.

(21) Appl. No.: 09/933,531

(22) Filed: Aug. 20, 2001

(65) Prior Publication Data

US 2002/0032101 A1 Mar. 14, 2002

Related U.S. Application Data

(60) Provisional application No. 60/227,545, filed on Aug. 24, 2000.

(51) Int. Cl.[7] ..... A63B 69/00
(52) U.S. Cl. ..... 482/12; 463/47.1; 446/473
(58) Field of Search ..... 482/12, 83, 84; 463/47.1–47.3; 446/473

(56) References Cited

U.S. PATENT DOCUMENTS 3,920,242 A * 11/1975 Reith et al. ..... 463/47.1
4,254,951 A * 3/1981 De Laney ..... 463/47.1
4,824,107 A * 4/1989 French ..... 273/454
4,892,303 A * 1/1990 Lohre ..... 482/12
5,836,853 A * 11/1998 Marciano ..... 482/12

* cited by examiner

*Primary Examiner*—Glenn E. Richman
(74) *Attorney, Agent, or Firm*—MacCord Mason PLLC

(57) ABSTRACT

An improved sensor is mounted at the tip of the blade of either foil or epee for scoring during fencing competition. The sensor transforms axial force, and optionally radial force, into changes in electrical resistance in one, or optionally two circuits. The resistance change is transformed into voltage change by a voltage divider circuit. The voltage is converted to a digital measurement by an analog-to-digital converter and compared to a reference value by a digital control element, such as a microprocessor. Push-button calibration is achieved by storing the reference value resulting from the force produced by gravity acting on a standard mass. When both radial and axial force components are sensed, the angle of the force relative to the axis of the sensor (and blade) can be computed and used to qualify the validity of the touché. A scoring box adapter performs the sensing and calibrating functions and provides signals for the inputs of scoring boxes and other equipment of prior art.

20 Claims, 2 Drawing Sheets

AUTO-CALIBRATING FORCE AND DIRECTION SENSING SCORING SYSTEM FOR FENCING

This application claims Provisional Appl. 60/227,545 filed Aug. 26, 2000.

BACKGROUND OF THE INVENTION

1. Field of the Invention

This invention pertains to the sport of fencing, and to devices used to electronically score competition fencing.

2. Description of the Prior Art

Prior art provides no method to sense the obliqueness or the direction of the strike during fencing. Only the axial magnitude of force is detected by a calibrated spring, which is arranged to oppose the operation of an Ohmic contact electrical switch at the tip of the blade of foil or epee. The switch of prior art operates, either opening in the case of foil, or closing in the case of epee, when the required axial force is applied during the process of achieving a valid touch, or touché.

In recent development of the sport of fencing, a technique has arisen in which the advancing fencer whips the blade of his weapon over the shoulder of his opponent, causing the blade to bend more than 90 degrees and the tip to contact the opponent's back with sufficient force to cause the tip sensor of prior art to register a valid touch. Since this "whip-over" attack bears no relationship to useful or historical technique for either foil or epee, it is desirable to provide a sensor or electronic scoring technology able to discriminate against it.

The need for calibration of the spring in the prior art greatly complicates the maintenance, administration, and management of the weapons used in competition. Before each competition, each contestant must submit his weapon to the controlling committee to be inspected for safety and to be checked for calibration against the gravity-generated force of a standard mass. All weapons passing inspection are retained by the controlling committee and are reissued to the contestant at the time of his competition. The calibration of all weapons is again checked against a standard mass at the start of each bout. All weapons failing to pass for safety or for calibration are returned to the contestant together with a yellow or red penalty card. The contestant may then replace or repair the weapon and resubmit it to the controlling committee. Repeating this cycle of inspection and repair to adjust or replace the spring introduces delays that are not compatible with broadcast scheduling of a tournament. It is desireable to provide a scoring system that can be automatically calibrated at the start of each bout without disassembly of the weapon.

Examples of relevant prior art, all of which contain one or more of the above limitations, are U.S. Pat. No. 3,920,242 to Reith and Overman (1975), U.S. Pat. No. 4,254,951 to De Laney (1981), U.S. Pat. No. 4,892,303 to Lohre (190).

SUMMARY

A blade tip sensor, scoring box signal input circuit, and scoring box adapter circuit are described. The sensor is comprised of a plunger, which is positioned in a cylinder with one, or optionally two elastic electrically conductive elements which sense applied force. One elastic electrically conductive element is positioned in the cylinder at the end of the plunger in such a way that principally axial force on the tip of the plunger compresses the conductive element. Optionally, a second elastic electrically conductive element is positioned near the tip of the plunger in such fashion that principally radial force acting on the tip of the plunger compresses a portion of the elastic electrically conductive element. The electrical resistance, in the circuits, which include the elastic conductive element between two rigid conductive surfaces, is reduced as compressive force increases due to the increase in area and reduction of the length of the electrical path through the elastic electrically conductive elements.

A scoring box or an adapter for scoring boxes of prior art provides circuitry to sense this change in circuit resistances of the sensor. These resistance changes produce a voltage changes in voltage divider circuits comprised of a fixed resistor and the variable resistors comprised of the elastic electrically conductive element between two rigid conductive surfaces. These voltages are either converted to digital measurements and compared to logically derived values by a digital control device, or they are compared by analog voltage comparators to voltages derived by reference voltage dividers such as potentiometers. In the case of the scoring box adapter, output circuitry of the adapter provides signals compatible with the inputs of scoring boxes of prior art.

REFERENCE NUMERALS IN DRAWINGS

Figure 1:
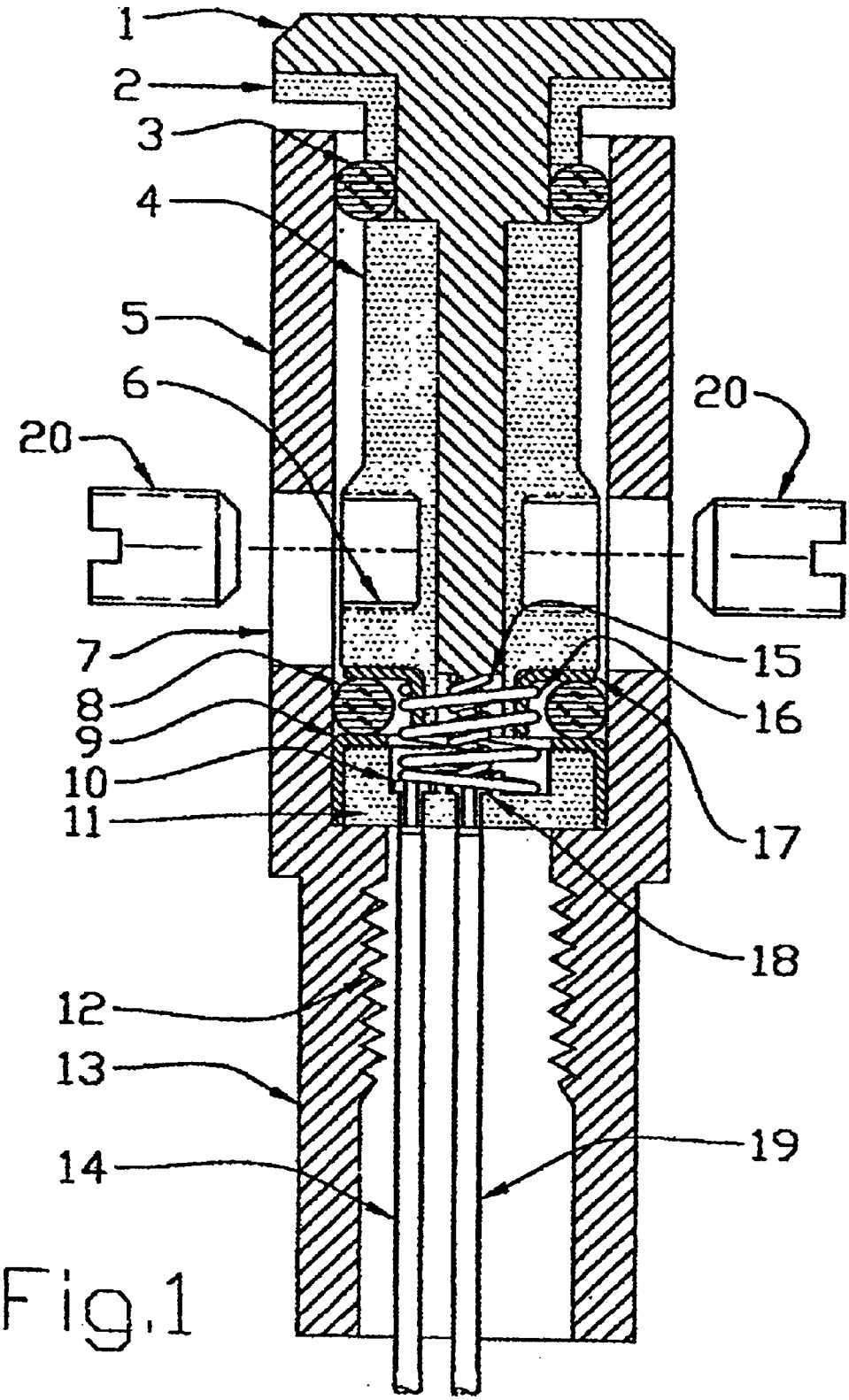
FIG. 1 is a mechanical cross section of the foil/epee tip sensor.

FIG. 1:

1: Shaft of plunger assembly
2: Insulating upper washer
3: Radial force sensing element
4: Insulating sleeve
5: Housing
6: Threaded hole in sleeve (2 places)
7: Aperture in housing to provide clearance for motion of the retaining set screws (2 places)
8: Axial force sensing element
9: Cup washer
10: Outer contact rivet
11: Insulating button
12: Threaded portion of housing for attachment and electrical connection to the threaded tip of the blade of a fencing weapon
13: Flatted surface to facilitate attachment and removal of tip sensor
14: Wire connecting outer contact rivet and flange washer to scoring circuitry. This wire carries the axial force signal.
15: Inner spring
16: Outer spring
17: Flange washer
18: Inner contact rivet
19: Wire connecting inner contact rivet and shaft to scoring circuitry. This wire carries the radial force signal.
20: Set screws (2 places)

FIG. 2:

RP1: Resistor network that provides eight reference resistors
RP2; Resistor network that provides eight current limiting resistors for opto-isolator LED's
U1: CMOS octal driver integrated circuit
U2-9: Opto-isolators or relays

DESCRIPTION OF THE PREFERRED EMBODIMENT OF THE INVENTION

The preferred embodiment of the sensor diagrammed in FIG. 1 comprises a tubular housing 5, plunger assembly 1, contact button assembly with two connecting wires 14 and 19, inner 15 and outer 16 contact springs, axial 8 and radial 3 sensor elements, and two retaining screws 20. The housing comprises a threaded portion 12 for attachment to the tip of the blade of foil or of epee, and a cylindrical section which houses the remaining components. Opposed openings 7 in the sides of the cylindrical portion admit the retaining screws 20 which prevent separation of the plunger assembly from the housing. The openings are large enough to permit movement of the plunger assembly to compress the axial sensor element 8 and the radial sensor element 3. The housing is in electrical contact with the blade and shield of the weapon.

The sensor elements 3 and 8 are composed of electrically conductive elastomer material, e.g. Chomerics type CHO-SEAL S6600 or type CHO-SEAL S6602. To simplify inventory, the sensor element for both axial and radial force component sensing should be of the same design. Either an O-ring or a simple flat washer shape of essentially square cross section can be used. While die cutting a flat washer is more economical than molding an O-ring, the electrical response of the O-ring to force may be more desirable over certain ranges of force. The response of the sensor may be modified by changing the texture of one or both rigid surfaces between which the elastic electrically conductive element is sandwiched. This texturing may be achieved by knurling, etching, threading, other machining process, or by intentionally leaving a coarse finish during machining.

The plunger assembly comprises a stainless steel shaft 1, an insulating upper washer 2, an insulating sleeve 4, and a conductive flange 17. The outer end of the shaft is shaped as a button that distributes the force of the touché to the opponent over a sufficiently large area to prevent penetration. Electrical low resistance contact can be made between this button and the opponent shield or lamé. The opposite end of the shaft is shaped as a post that is pressed into one end of the inner contact spring 15. The upper washer 2 limits the axial and radial compressive travel of the shaft assembly, insulates the shaft 1 from the housing 5, and forms one wall of the retaining groove for the radial sensor element 3. The sleeve 4 is either bonded or tightly press fitted to the shaft 1 to prevent separation of sleeve from shaft. To enhance retention, the shaft may be knurled or coarsely finished in the area contacting the sleeve. The sleeve forms the opposite wall of the retaining groove for the radial sensor element 3, insulates the remainder of the shaft from the housing 5 and from the conductive flange washer 17, mechanically supports the conductive flange washer 17, and receives the two retaining screws 20. The conductive flange washer 17 is loosely pressed onto the end of the sleeve 4, and is pressed into one end of the outer contact spring 15. The conductive flange provides one rigid surface that compresses the axial sensor element 8 against the top surface of the contact button assembly at the inner end of the cylindrical opening of the housing 5.

The contact button assembly is comprised of an outer cup washer 9, an insulator button 11, and two contact rivets 10 and 18 which are each crimped or silver soldered to a connecting wire 14 and 19. The cup washer 9 is in electrical contact with the housing 5 and provides one rigid electrically conductive surface against which the axial sensor element is compressed. The wires 14 and 19 are threaded through holes in the insulating button 11 and the rivets are pressed into the holes so that the tops of the rivets are positioned to make contact, each with one of the contact springs. A raised ridge feature of the insulating button separates the inner and outer contact springs. A central hole in the cup washer admits the inner and outer contact springs as the plunger assembly is assembled into the housing, and prevents contact between the cup washer 9 and the outer contact spring 15. The inner and outer contact springs provide mechanically compliant electrical connection between the center contact rivet 18 and the shaft 1, and between the outer contact rivet 10 and the flange washer 17. The compression force developed by the two contact springs is arranged to be small compared to the axial force to be measured.

Figure 2:
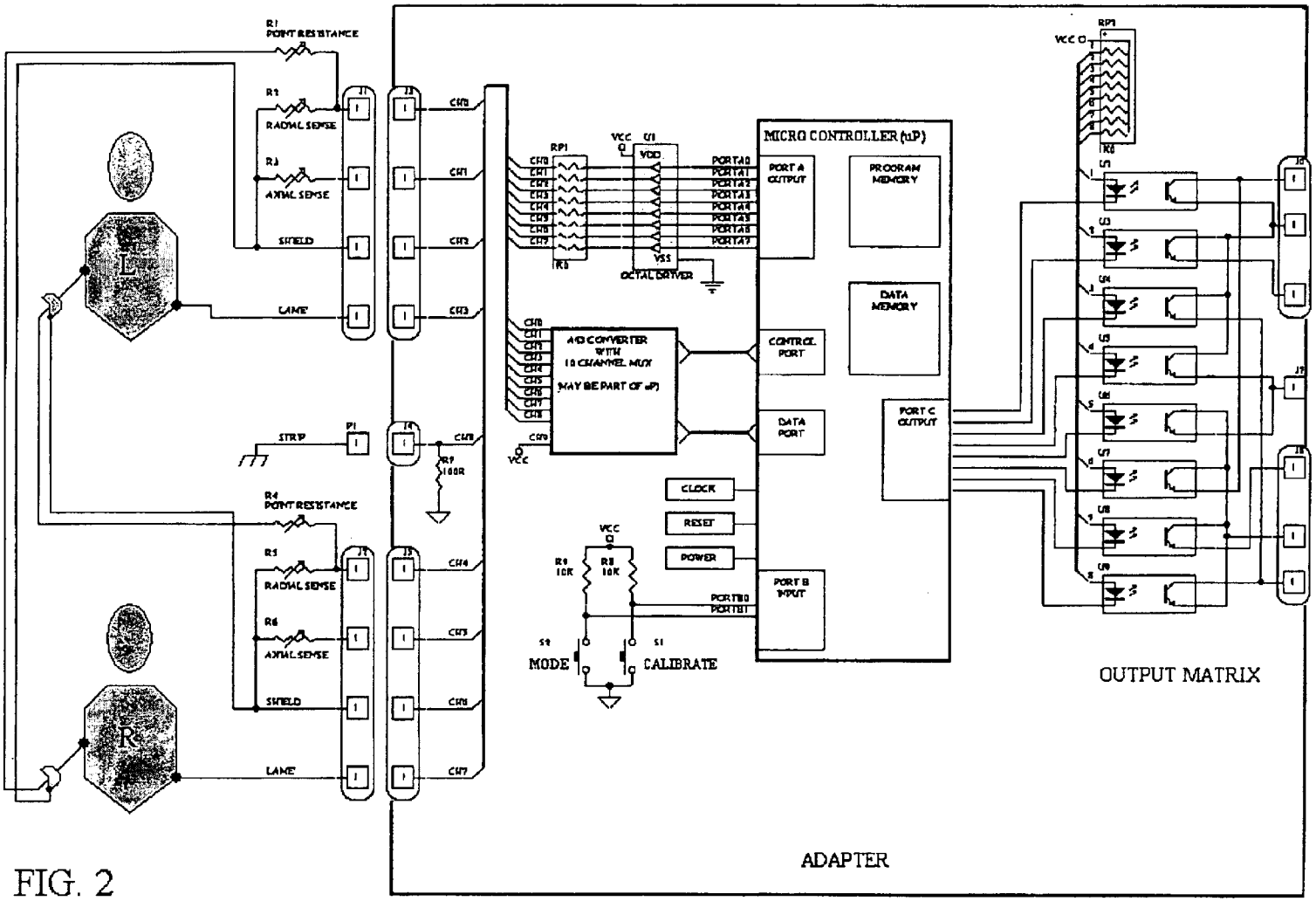
FIG. 2 is a block diagram of the electronic control of the present invention.

The preferred embodiment of the adapter diagrammed in FIG. 2 comprises an enclosure and a printed wiring board assembly (i.e. circuit board). The enclosure supports connectors J1 and J2 for fencing weapons of the preferred embodiment and connectors for cables to connect to scoring boxes and other devices of the prior art. The circuit board supports the input circuitry components, a microcontroller or microprocessor typically possessing an analog-to-digital converter, support components for the microprocessor, a low voltage power system such as a 9 volt Mallory model MN1604 battery, power regulator or management circuit, an optional precision voltage reference, push-button switches with pull-up resistors for operator selection of mode and start of calibration, diagnostic and programming components and connections, and output circuitry that is controlled by the microprocessor to produce switch closure signals for scoring equipment compatible with sensors of the prior art. The input circuitry comprises stable reference resistors RP1 that form voltage dividing circuits with the resistance of the sensor elements, and CMOS drivers U1 that connect the reference resistors either to VCC (typically +5 Volts) or to VSS (0 Volt reference, or "Ground").

The program running in the microcontroller determines the values of R1 through R6 by first presenting various patterns as the output of PORT A to connect one or more of the reference resistors in RP1 to VCC while the rest are connected to VSS and using the analog-to-digital converter (A/D CONVERTER, or ADC) to measure the voltages CH0 through CH7. The program then computes the values of currents and resistances using Ohm's law (R=E/I, I=E/R, I=E*R). For best accuracy, the drivers of U1 should present consistent low resistance in the "on" state. FIG. 2 shows VCC being sampled at CH9, but this function can be achieved by using VCC as a reference input to a scaling ADC.

A scoring system of the preferred embodiment differs from the adapter previously described by replacement of the output matrix circuitry with high power driver circuits and connectors for scoring indicator lights, additional connections with input circuits to accommodate sensors of prior art, and various optional output circuits and connectors for such functions as serial connection to a personal computer and interface to timer and score totalizer displays.

We claim:

1. A force sensor tip for a fencing weapon for use in fencing competition comprising a housing adapted for mounting on a distal end of an elongated fencing weapon and having a first sensor sensing touches with a force component primarily in the direction of the weapon's elongation, a second sensor sensing touches with a force component primarily transverse to the weapon's elongation, and an electrical connection to a scoring box to communicate touches sensed by the sensors.

2. A force sensor tip as claimed in claim 1 wherein the first sensor includes an electrically conductive elastomeric material, the resistance of which changes upon application of a force component primarily in the direction of weapon elongation.

3. A force sensor tip as claimed in claim 1 wherein the first sensor includes an electrically conductive elastomeric O-ring, the resistance of which changes upon application of a force component primarily in the direction of weapon elongation.

4. A force sensor tip as claimed in claim 1 wherein the second sensor includes an electrically conductive elastomeric material, the resistance of which changes upon application of a force component primarily transverse to the direction of weapon elongation.

5. A force sensor tip as claimed in claim 1 wherein the second sensor includes an electrically conductive elastomeric O-ring, the resistance of which changes upon application of a force component primarily transverse to the direction of weapon elongation.

6. A force sensor tip as claimed in claim 1 wherein the housing is substantially tubular and has a movable plunger extending axially therein, the sensors sensing axial and radial movement of the plunger as their respective touches.

7. A force sensor tip as claimed in claim 6 wherein the plunger is surrounded by an insulating sleeve within the housing and the first sensor includes an electrically conductive elastomeric material axially positioned between the insulating sleeve and an internal shoulder in the housing, so the elastomeric material is compressed upon application of a force component primarily in the direction of weapon elongation, changing its resistance to current flow to the electrical connection.

8. A force sensor tip as claimed in claim 7 further comprising a first conductive washer positioned between the insulating sleeve and the elastomeric material and electrically isolated from the housing and a second conductive washer positioned between the elastomeric material and the internal shoulder, the first washer providing an electrical path to the electrical connection to the scoring box.

9. A force sensor tip as claimed in claim 6 wherein the second sensor is an electrically conductive elastomeric material ring between the plunger and the housing, so the elastomeric material is compressed upon application of a force component radial to the direction of weapon elongation, changing its resistance to current flow to the electrical connection.

10. A force sensor tip as claimed in claim 6 wherein the both sensors include respective electrically conductive elastomeric materials, the resistance of which changes upon application of a force component in the direction of the force sensed by that sensor.

11. A force sensor tip as claimed in claim 6 wherein the plunger has a normal position within the housing and further comprising a spring to restore the plunger to the normal position between touches.

12. A force sensor tip for a fencing weapon for use in fencing competition comprising a substantially tubular housing adapted for mounting on a distal end of an elongated fencing weapon and having a movable plunger extending axially in the housing, a first sensor including an electrically conductive elastomeric material positioned to be compressed by axial movement of the plunger so the resistance of the first sensor's elastomeric material decreases to sense axial touches, a second sensor including electrically conductive elastomeric material positioned to be compressed by radial movement of the plunger so the resistance of the second sensor' elastomeric material decreases to sense radial touches, and an electrical connection to a scoring box to communicate touches sensed by the sensors.

13. A force sensor tip as claimed in claim 12 in which the plunger is surrounded by an insulating sleeve within the housing and the first sensor is positioned between the insulating sleeve and an internal shoulder in the housing.

14. A force sensor tip as claimed in claim 13 further comprising a first conductive washer positioned between the insulating sleeve and the elastomeric material of the first sensor and electrically isolated from the housing and a second conductive washer positioned between the elastomeric material of the first sensor and the internal shoulder, the first washer providing an electrical path to the electrical connection to the scoring box.

15. A force sensor tip as claimed in claim 14 wherein the plunger has a normal position within the housing and further comprising a spring to restore the plunger to the normal position between touches.

16. A method of scoring touches in fencing comprising electrically sensing touches between a tip of a fencing weapon and a target, and automatically determining touches that have a force component primarily in the direction of the weapon's elongation and touches with a force component primarily transverse to the weapon's elongation.

17. A method as claimed in claim 16 wherein the automatic determination effected by separately sensing forces primarily in the direction of the weapon's elongation and forces primarily transverse to the weapon's elongation.

18. A method as claimed in claim 16 further comprising electrically transmitting the electrically sensed touches to a scoring box.

19. A method of scoring touches in fencing comprising a. electrically sensing touches between a tip of a fencing weapon and a lamé, b. automatically discriminating between touches that have a force component primarily in the direction of the weapon's elongation and touches with a force component primarily transverse to the weapon's elongation by separately sensing forces primarily in the direction of the weapon's elongation and forces primarily transverse to the weapon's elongation; and c. electrically transmitting the electrically sensed touches to a scoring box.

20. A method of scoring touches in fencing comprising electrically sensing changes is the resistance of an electrically conductive elastomeric material effected by compression of the material by touches between a tip of a fencing weapon and a target.

* * * * *